United States Patent [19]

Kuhns

[11] 4,306,414

[45] Dec. 22, 1981

[54] METHOD OF PERFORMING WORK

[76] Inventor: John P. Kuhns, 1332 Kathryn St., Hurst, Tex. 76053

[21] Appl. No.: 57,734

[22] Filed: Jul. 16, 1979

Related U.S. Application Data

[63] Continuation-in-part of Ser. No. 791,381, Apr. 27, 1977, abandoned.

[51] Int. Cl.[3] ..... F02G 1/00

[52] U.S. Cl. ..... 60/510; 60/650

[58] Field of Search ..... 60/516, 508, 650, 682, 60/683, 510, 526

[56] References Cited

U.S. PATENT DOCUMENTS

| | | | |
|---|---|---|---|
| 673,462 | 5/1901 | Thornton et al. | 60/510 X |
| 2,391,078 | 12/1945 | Thomsen | 60/526 |
| 3,183,662 | 5/1965 | Korsgren, Sr. | 60/526 X |
| 4,008,574 | 2/1977 | Rein | 60/683 X |

*Primary Examiner*—Allen M. Ostrager
*Assistant Examiner*—Stephen F. Husar
*Attorney, Agent, or Firm*—Wm. T. Wofford; James C. Fails; Arthur F. Zobal

[57] ABSTRACT

Method of and apparatus for doing work characterized by the steps of establishing respective hot and cold zones within a constant volume chamber; providing a flow path intermediate the zones and encompassing a caloric energy storage means for extracting heat from gases that are hotter and for delivering heat to gases that are colder as the respective gases are flowed therepast; separating the respective hot and cold zones by reciprocally movable member that is movable longitudinally of its cylinder and periodically reciprocally moving the member whereby to effect the following steps; (a) taking in the relatively cool ambient air into the cold zone; (b) moving the cool ambient air past the caloric energy storage means to pick up heat and become relatively hotter to tend to expand and increase pressure; (c) passing the hotter air from the chamber to an engine means for producing work; (d) passing a high temperature fluid in heat exchange relationship with the caloric energy storage means to again heat the caloric energy storage means and store heat and repeating steps (a)-(d). Also disclosed are specific preferred embodiments and apparatuses.

4 Claims, 6 Drawing Figures

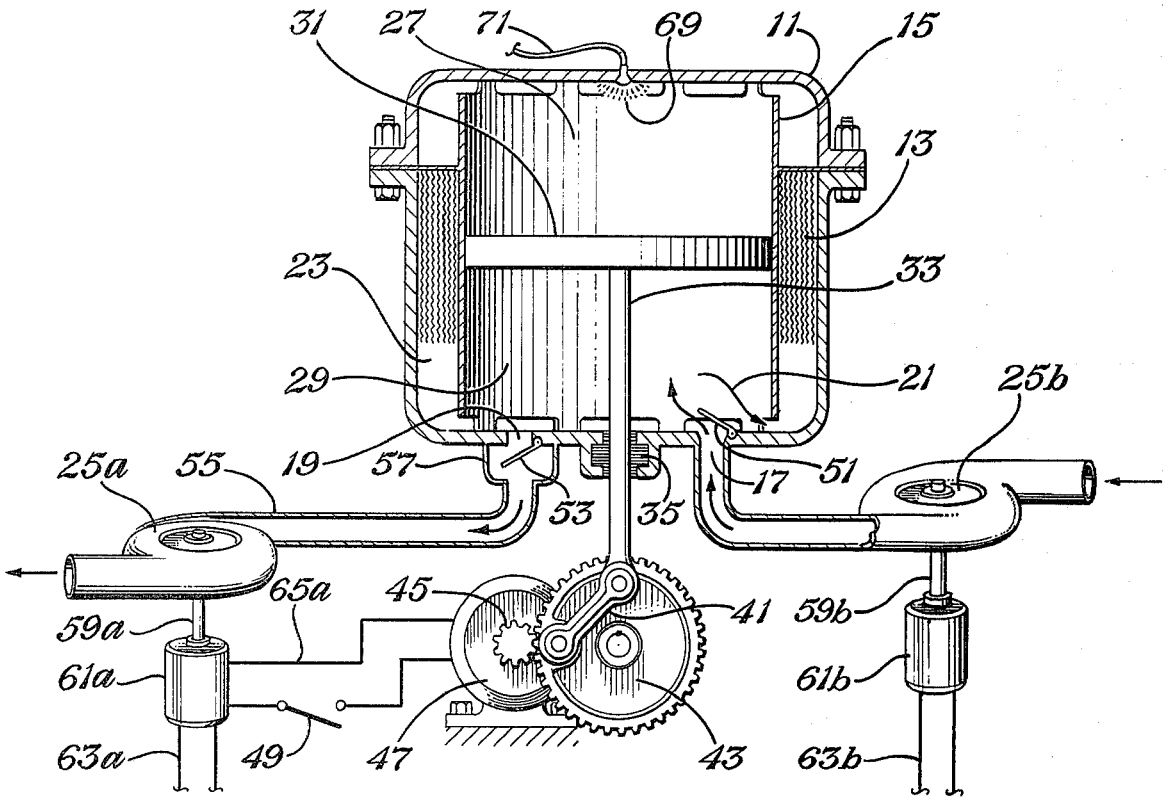
Fig. 5
Fig. 6
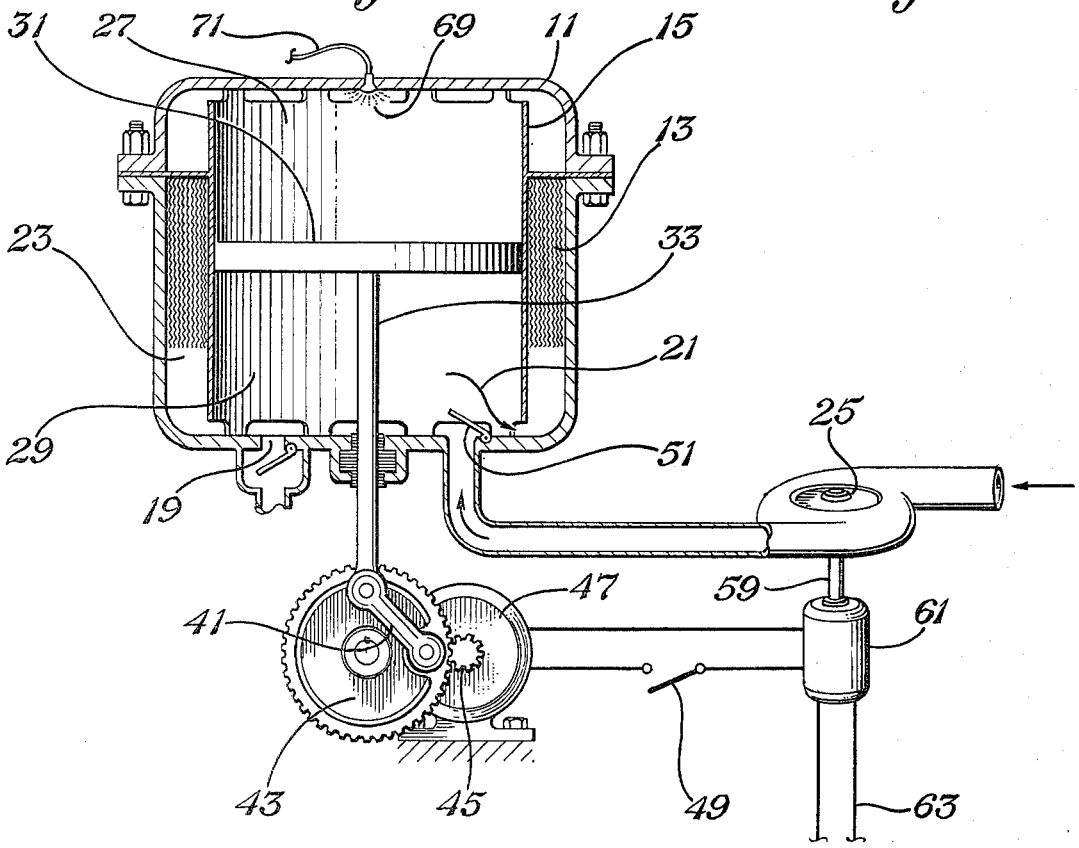

METHOD OF PERFORMING WORK

This application is a continuation-in-part of Ser. No. 791,381, filed Apr. 27, 1977, now abandoned.

BACKGROUND OF THE INVENTION

1. Field of the Invention

This invention pertains to a method of and apparatus for producing useful work. More particularly, this invention relates to a method and apparatus for obtaining improved conversion of caloric energy to mechanical energy for doing work.

2. Description of the Prior Art

The various methods of the prior art have been given various names for the respective cycles. Typical of these are Newcome, Watt, Sterling, Lenoir, Rankine, Brayton, Otto, Diesel and the like. These prior art methods suffer from the common short coming which is generally poor overall conversion of caloric energy to mechanical energy. The very best engines typically waste twice as much energy as they can convert into mechanical power. One large source of energy loss is high exhaust temperatures. Another loss results from untimely heat exchange between the working fluid and interior engine surfaces. Still another significant loss is the mechanical losses due to friction because of the high working pressures that have resulted from the general misconception that high efficiency requires high compression. Moreover, the structural demands of high temperature, high compression and high stresses have increased the costs of apparatus. Where internal combustion was a source of energy within an engine, there have been these disadvantages plus the disadvantage resulting from incomplete combustion within the engine and the resulting pollutants being discharged into the atmosphere.

Experience has indicated that it is desirable that the method and apparatus for producing useful work should provide one or more of the following features not heretofore provided.

(1) The method and apparatus should follow a work cycle in which the fluid that is exhausted is a relatively lower temperature than the fluid of the prior art work cycles.

(2) The method and apparatus should follow a work cycle which avoids unwanted heat exchange between the fluid and engine components so as to conserve energy and improve efficiency.

(3) The method and apparatus should follow a work cycle that enables low pressure operation and, hence, have low structural requirements; in contrast to the high pressure and high stress at high temperature.

(4) The method and apparatus should reduce pollutants.

(5) The method and apparatus should be widely useful with the different known sources of energy such as prime exothermic reactions of fission, fusion, reduction and be applicable to secondary sources such as process waste heat, refuse disposal and electromagnetic radiation.

(6) The apparatus for producing work should have a construction in which the moving parts, valves, dynamic seals and the like need not be subjected to the heat source high temperature, thereby increasing the peak temperature permissible in the engine and improving caloric energy conversion efficiency.

From the foregoing it can be seen that the prior art has not provided the totally satisfactory solution by providing method and apparatus that have the foregoing features.

SUMMARY OF THE INVENTION

Accordingly, it is an object of this invention to provide method and apparatus that accomplishes one or more of the foregoing features delineated as desirable and not heretofore provided, while obviating the disadvantages of the prior art.

It is a specific object of this invention to provide method and apparatus that has all of the foregoing features delineated as desirable and not heretofore provided.

These and other objects will become apparent from the drawings and descriptive matter hereinafter.

In accordance with this invention, there is provided a method of performing work characterized by the steps of establishing respective hot and cold zones within a constant volume chamber; providing a flow path intermediate the zones with a caloric energy storage means for extracting heat from gases that are hotter and for delivering heat to gases that are colder as the respective gases are flowed therepast; separating the respective hot and cold zones and providing a circulation means for compelling periodic counter current relative flow between the caloric energy storage means and a working fluid mass being employed; adding heat to the fluid masses and passing compressed fluid to a work producing means responsive to forceful mass flow. The heat is added to the fluid and the expansive flow effected without requiring high pressures and large working stresses as required in the prior art.

In accordance with another embodiment of this invention, there is provided apparatus for producing work comprising:

a. a constant volume pressure vessel having hot and cold zones within a constant volume chamber;

b. a caloric energy storage means;

c. a flow path intermediate the hot and cold zones and encompassing said caloric energy storage means for extracting heat from gases that are hotter and for delivering heat to gases that are colder when passed through said flow path;

d. a means separating said hot and cold zones;

e. a circulation means for compelling periodic counter current relative flow between the caloric energy storage means and a working fluid such that said working fluid can be passed in heat exchange relationship to expand and the extra expanded volume can be passed to a work producing device;

f. a means for adding heat to said fluid within said vessel;

g. means for porting said vessel to a reservoir of said working fluid;

h. a work producing means; and i. means for directing the increased volumetric amount of said working fluid to the work producing means for producing work.

In its broader aspects, this invention embodies a method of converting heat to work characterized by the steps:

a. regenerative poly-entropic heating of entrapped working fluid, producing compressive rarefaction, thereby motivating working fluid mass adiabatic flow from entrapment space;

b. regenerative poly-entropic removal of heat from said entrapped working fluid producing decompressive densification motivating working fluid mass adiabatic flow into said entrapment space;

c. heat source sustained continuing repetition of above alternating cyclic sequence causing said motivated mass flows specific heat adiabatic temperature change product, minus friction losses approximately equaling potentially useful work output.

BRIEF DESCRIPTION OF THE DRAWINGS

FIG. 5 is a schematic view of an apparatus of FIG. 1 with the work producing engine means connected with the suction side of the engine.

FIG. 6 is a schematic view of an apparatus in accordance with one embodiment of this invention with work producing engine means connected with both the inlet and the outlet of the apparatus.

DESCRIPTION OF PREFERRED EMBODIMENTS

Figure 1:
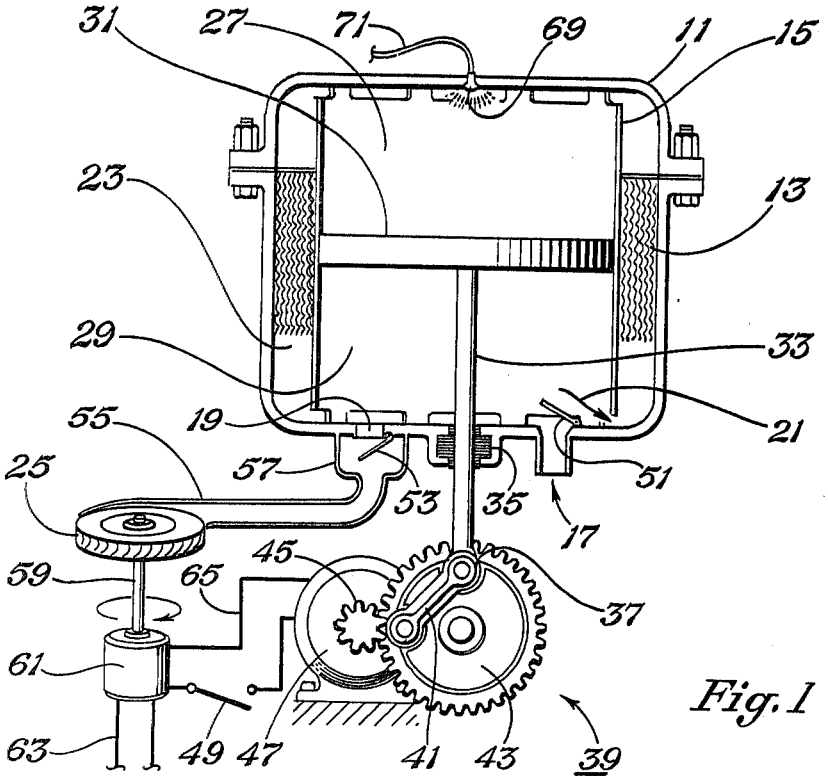
FIG. 1 is a schematic view of an apparatus in accordance with one embodiment of this invention.

Referring to FIG. 1, a pressure vessel 11 has disposed therewithin a caloric energy storage means, such as a corrugated metal foil 13, and a cylindrical sleeve 15. The pressure vessel 11 may be formed of metal such as cast iron, cast aluminum, or the like. It may be formed in two parts such as a head and a block enjoined by suitable gasket. Pressure vessel 11 has suitable inlet port 17 and exhaust port 19.

The cylindrical sleeve 15 is shorter in dimensions than the pressure vessel 11 so as to provide an air passage 21 about its ends. The cylindrical sleeve 15 is also smaller in radial dimensions than is the pressure vessel 11 so as to define an annular air passage 23 between the outer wall of the cylindrical sleeve 15 and the inner wall of the pressure vessel 11.

The corrugated metal foil is wound in belt form on the approximate mid point of the cylindrical sleeve 15. The coil of corrugated metal foil belt has enough heat capacity to remove the heat from air at a temperature in the range of about 1500° F., about 2000° R (Rankine) and reduce to near ambient the temperature of the air discharged from a work producing means such as turbine 25.

The cylindrical sleeve 15 has respective hot zone 27 and cold zone 29. A piston 31 separates the respective hot and cold zones 27 and 29. The piston 31 is easily reciprocally movable within the cylindrical sleeve 15. A piston rod 33 is connected with the piston 31 and extends outwardly through stuffing box 35. The stuffing box 35 sealingly engages the piston rod and prevents venting of air therethrough while allowing reciprocal movement of the piston rod 33 and the piston 31.

The piston rod 33 is connected, at its lower end 37, with a reciprocation means 39. The reciprocation means 39 may comprise any of the means for effecting the reciprocal movement of the piston 31. As illustrated, it comprises an angled arm 41 connected adjacent the periphery of a fly wheel 43 having a toothed periphery. A drive gear 45 engages the toothed periphery of the fly wheel 43 and rotates it responsive to torque from a motor 47. The motor 47 is driven by suitable controls, illustrated schematically by switch 49. The reciprocation means 39 may be low power, since the piston is not opposed by high pressure but is employed merely as a circulation means for circulating gaseous fluid within the vessel 11 between the hot and cold zones 27 and 29.

An inlet check valve 51 allows inlet air to be aspirated into the pressure vessel 11 but closes as the air is heated and begins to expand to increase the pressure therewithin.

Conversely, a discharge check valve 53 is provided in the discharge port 19 and begins to open to allow relatively cool air to flow through the turbine 25 as other contained air is heated. When a lesser pressure is experienced, however, the exhaust check valve 53 closes to prevent backflow of air.

The turbine 25 is connected in fluid communication, as by conduit 55 with the exhaust port 19 and exhaust check valve 53. Specifically, a housing 57 is connected with the pressure vessel 11 surrounding the exhaust port 19 to facilitate connection of the conduit 55. The turbine 25 discharges to a suitable sink, such as ambient air. The turbine 25 is connected, as by shaft 59 with the remainder of suitable work producing means, typified by generator 61. The generator 61 is connected by suitable conductors 63 with transmission lines or the like for use of electrical power generated. As indicated hereinbefore, a part of the power is taken off by way of the conductors 65 incorporating the controls, or switch, 49 for motor 47.

A heat addition means, such as the illustrated burner 69, is provided in the hot zone 27 for adding heat. The burner 69 may comprise a fuel injector adjacent a glow plug or the like. The burner 69 is connected with a source of fuel, as by conduit 71. The combustion may be intermittent if desired. As illustrated, however, it is continuous by the injection of a small amount of fuel by a metering pump (not shown).

Figure 2:
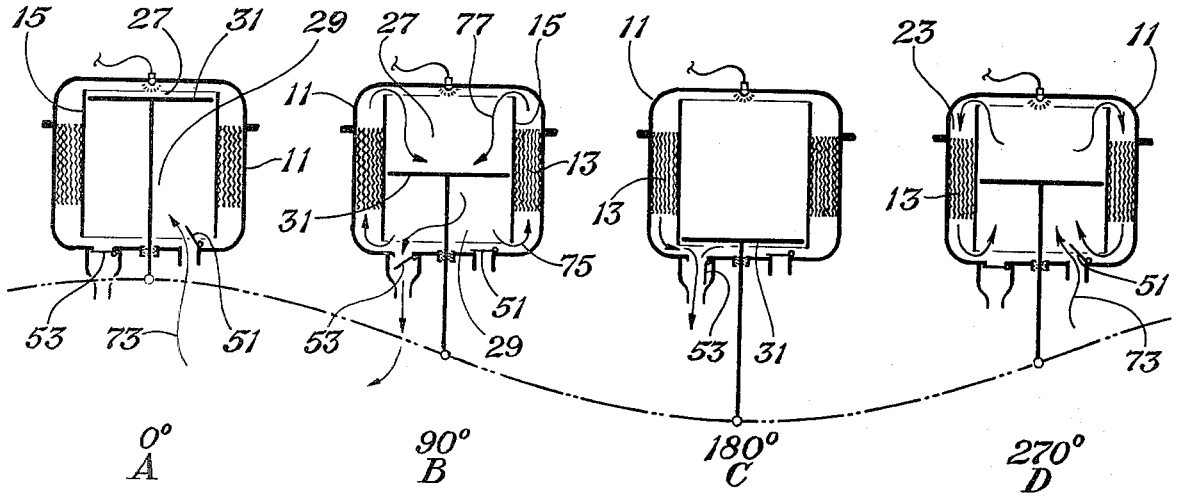
FIG. 2 is a schematic illustration containing sub figures A–D showing the respective steps in the operation of the embodiment of FIG. 1.

The invention is explained hereinafter by referring to FIG. 2, sub figures A–D. Referring to sub figure 2A, piston 31 has just finished moving upwardly in the cylinder 15 and fresh air has been drawn into cold zone 29 through the inlet check valve 51, as indicated by the arrow 73.

As the piston 31 moves downwardly, sub figure 2B, air inside the vessel is forced from the cool zone 29 around the end of the cylinder 15 and past the caloric energy storage means, or metal foil belt 13, where it picks up heat once the hot end of metal foil belt is hot. As the air moves into the hot zone 27, it supplies oxygen for the continued combustion of the injected fuel. The flow path is indicated by the arrows 75 and 77. During this time as air is being heated, thermal expansion causes some of the cool air 29 to flow through valve 53 and proceed on to drive turbine 25. The stroke continues until at 2C, the entire interior contains air and combustion products at a higher mean temperature than prevailed earlier, as illustrated in sub figure 2A. Immediately, the piston 31 starts back, sub figure 2D. Hot gases 27 flow through metal foil 13 and are cooled to near ambient as they exit to cool zone 29. Simultaneously due to thermal contraction of cooling, fresh air 73 is drawn in through check valve 51, after which the cycle is repeated.

As is recognized, the weight, or mass, of a volume of air is determined by a formula similar to formula I.

$$W = PV/53.3(T) \quad \text{I}$$

where:

W = weight in units commensurate with the constant,

P = pressure in absolute units, also commensurate

V = volume in commensurate units,

T = absolute temperature in degrees, also commensurate.

As is recognized, the constant 53.3 implies the use of English system units such as pounds, pounds per square foot, cubic feet, and degrees Rankine, respectively. From formula I it is evident that, since the temperature is now higher, the volume is the same, and the pressure relatively unchanged if discharged against the atmospheric pressure, a portion of the air is expelled. If the discharge gas is passed to turbine 25, the absolute pressure is increased by the back pressure of the turbine 25.

As the unit reaches equilibrium conditions, the temperature of the air changes from low temperature of about 500° R to the upper temperature of about 2000° R. Thus, from sixty to eighty percent of the volume of the air is flowed out exhaust check valve 53. Most of the air will have been discharged by the time the piston 31 reaches its bottom dead center, or 180° position, sub figure 2C.

As the piston 31 begins to move upwardly as shown in sub figure 2D, the hot gas above the piston is circulated downwardly through the annular passageway 23 past the metal foil 13 to give up its heat to the metal foil. Simultaneously, because of thermal contraction fresh air is sucked inwardly through the inlet check valve 51, as indicated by arrow 73. The metal foil has large mass and heat capacity compared to the gas that is moved therepast. Consequently, the foil removes and stores substantially all the surplus heat from the gas that passes on its return trip to the cool end of the pressure vessel.

As the stroke of the piston 31 proceeds to its end, as shown in subfigure 2A, the entire interior of the constant volume chamber 11 contains combustion products and fresh air at a lower mean temperature than prevailed earlier at subfigure 2C.

The next stroke, sub figure 2B, proceeds immediately. As the fresh air flows upwardly past the metal foil belt 13, it absorbs heat from the caloric energy storage mass. Thus the air becomes heated as it passes to the hot end. More fuel has burned, and combusts in the fresh air arriving so as to provide additional heat. As heat is added, the air expands. A portion passes to turbine 25, as previously described.

As cycling continues, fresh ambient air is sucked in, the hot gases give up heat to the foil 13; fresh air is circulated past the hot foil 13 to become heated, in turn; additional fuel is burned; and the extra volume of gas is expelled at essentially a lower temperature due to the thermally isolating caloric energy storage means in the form of the metal foil belt 13. The hot end 27 continues to get hotter up to the desired high temperature limit set point. Mechanical power is generated by the cool end gases exhausting through the turbine. Note that exhaust is relatively cool but still is hotter than inlet air. The fuel quantity burned is limited to a safe rate below the melting point of the components in the hot end. It is noteworthy in this respect that very low structural demands are made on the parts subjected to this high temperature, so less expensive components and higher combustion temperature can be employed in the engine.

As indicated hereinbefore, there will occur intermittent pulses of the gas to the turbine from a single one of the pressure vessels 11. Consequently, it is desirable to connect a plurality of the pressure vessels 11 to the turbine 25 for a more nearly constant flow and for efficient generation of power by the turbine 25.

If desired, the pressure vessel 11 may be insulated to reduce the heat energy that might otherwise be dissipated to surroundings. One of the advantages of this invention is that no cooling is required except the heat of compression to turbine inlet pressure which is removed as engine exhaust temperature above ambient. No additional engine cooling is needed or desired.

Specifically, the components are designed such that the peak pressure occurring inside the pressure vessel 11 will never exceed about 50 pounds per square inch absolute. Ordinarily, the pressure inside the pressure chamber will be determined by the back pressure on the turbine and will run from about 10 to about 20 pounds per square inch gauge, so no part of the unit is required to withstand high pressure and high temperatures simultaneously.

There are several unique advantages enjoyed by a combustion engine that operates in accordance with this invention. These include the following. (1) The combustion temperatures can be considerably higher than current limits because the stressed moving parts are not exposed to the high combustion temperatures, thus thermal efficiency approaching about 78 percent can be realized. (2) Heat leakage losses are low because the high temperature charge does not pass through the low temperature engine zones because its sensible heat is removed by the caloric energy storage means, foil 13. (3) Combustion can be more nearly complete; because an excess of air is supplied to the fuel and combustion is initiated and consumated at high temperature without time limit so much lower concentrations of pollutants are discharged to the atmosphere. (4) Motor efficiency is higher because only a net effect expander employing a low pressure drop is required. A larger expander that must provide drive power for proportionally high pressure compressor is unnecessary. (5) There are no external combustion stack losses or special equipment required to minimize such heat losses. (6) There are no sealed fluids at high pressure to require the expense of guarding against leaks thereof. (7) There are no two phase latent heat losses and no condensers, nor radiators required; since the heat generated is retained internally for processing into expander power. (8) The electric and lubrication requirements are minimized. (9) There appears to be no critical limit to the size of the units that can be installed to operate in accordance with the described processes. Moreover, any number of reactor sections can be connected in parallel, or manifolded, to feed the turbine, or expander, of almost any desired capacity. The units may range in size from those small enough to be held in the hand to large units such as are employed for power stations or the like.

Figure 3:
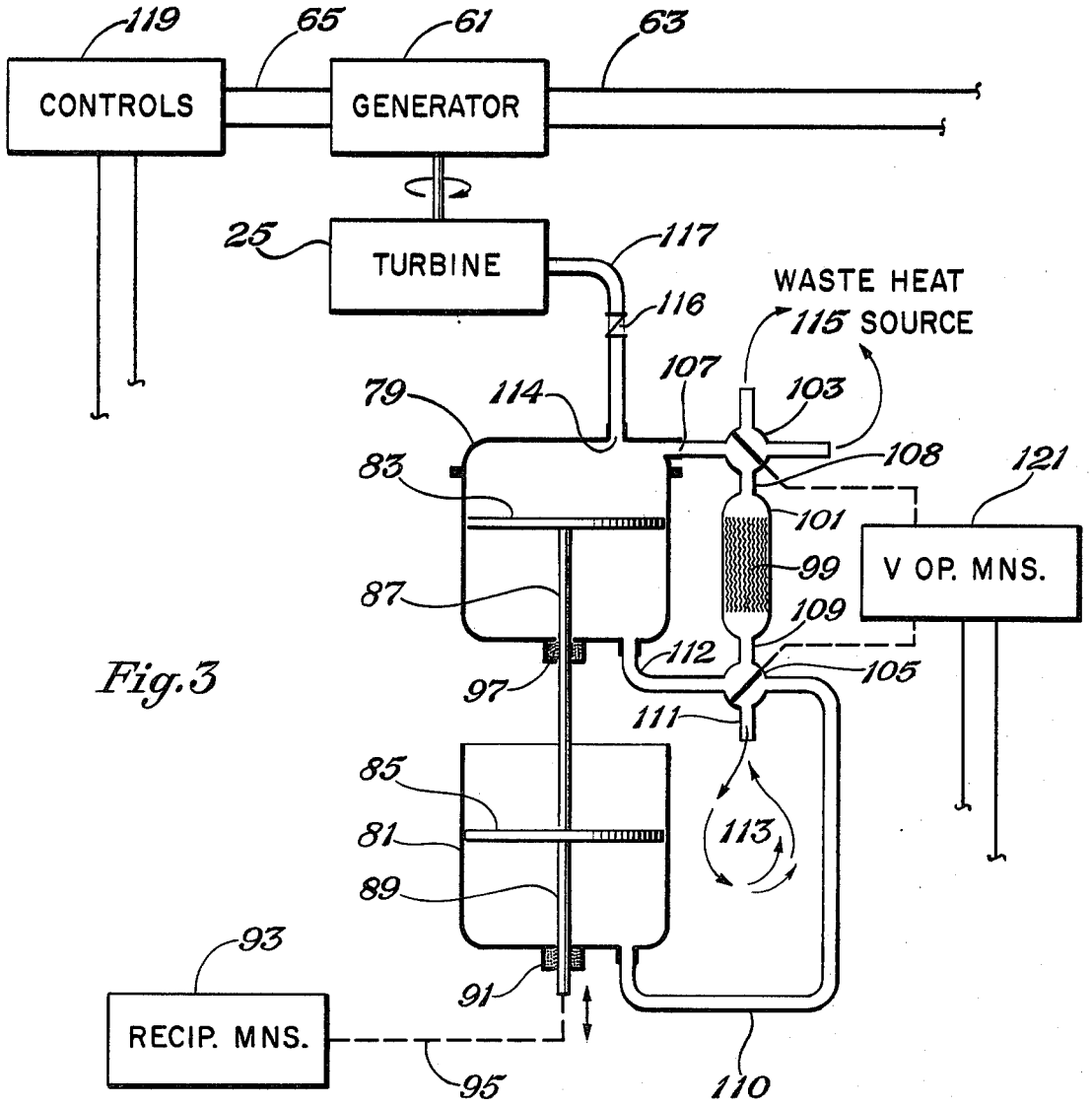
FIG. 3 is a schematic illustration of another embodiment of this invention.
Figure 4:
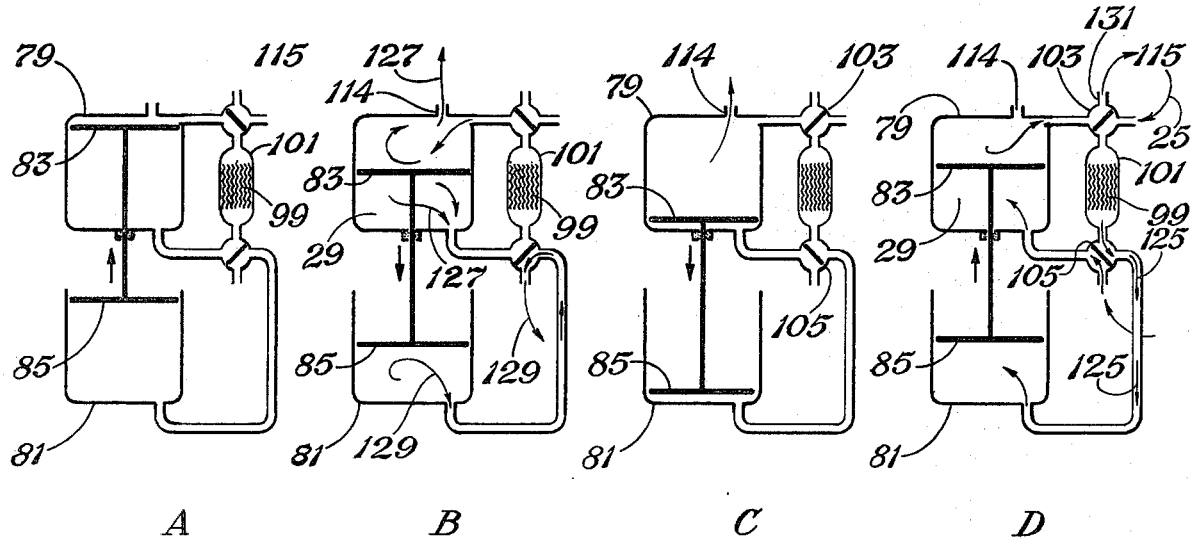
FIG. 4 is a schematic illustration containing sub figures A–D showing the respective steps in operation of the embodiment of FIG. 3.

This invention may be employed in other embodiments, also. One such embodiment is illustrated in FIGS. 3 and 4. The embodiment of FIG. 3 illustrates apparatus for extracting caloric energy from a hot zone, such as process waste heat, and converting it to useful work. Therein, the pressure vessel 79 comprises a double ended cylinder. Aligned with the double ended cylinder 79 is a single ended cylinder 81. Disposed in the respective cylinders are pistons 83 and 85. The pistons 83 and 85 are connected to each other by connecting rod 87. A piston rod 89 extends from piston 85 outwardly through stuffing box 91 for effecting reciprocal movement,. As described in FIG. 1, a reciprocating means 93 (RECIP MNS), is connected, as indicated by dashed line 95, with the piston rod 89 for effecting the reciprocal movement.

The respective cylinder 79 may comprise any suitably structurally strong cylinder, such as cast or machined iron alloys, or steel; aluminum, and the like. The pistons, connecting rods, piston rods, and the like are well known and may be machined from steel parts, similarly as with the piston and piston rod of FIG. 1. Respective pistons sealingly fit the walls of their respective containing cylinders but not so tightly but what they are readily reciprocally moved without expenditure of a large amount of power. The connecting rod 87 sealingly traverses through a stuffing box 97 in the bottom of the lower chamber of cylinder 79.

In the embodiment of FIG. 3, the caloric heat storage means, such as the corrugated metallic foil 99, is disposed in a separate vessel 101. The vessel 101 may be insulated if desired, to lower heat losses.

Suitable valves 103 and 105 and suitable passageways 107–112 connect the respective chambers with ambient atmosphere 113 and a source of heat, such as a waste heat source 115.

The pressure vessel has a discharge port 114 that is connected by a suitable conduit, as shown schematically by line 117 with a turbine 25. The turbine is drivingly connected with a generator 61 that has the previously described conductors 63 and 65 connected thereto. Suitable controls 119 are provided for controlling the reciprocation means and the operation of the respective valves 103 and 105. The valves are operated by the valve operating means (OP MNS) 121. The valve operating means may comprise electrical solenoids or the operating portion of pneumatically operated valves, hydraulically operated valves, and the like, depending upon the type valves that are employed. Controls for effecting the switching of the valves may comprise respective connected limit switches (not shown) or the like for sensing the extreme positions of movement of the pistons. These are commercially available, their installation is conventional and need not be described in detail herein.

Reference is made to sub figure 4D which illustrates the flow of the fluids during the aspiration phase of the engine cycle. As the piston 85 is moved upwardly, hot source air 115 is drawn past the metal foil 99 in the vessel 101, as shown by the arrows 125. The valves 103 and 105 are positioned so to effect this flow path. The heat is removed from the air or hot fluid, by the metal foil 99 and stored. Simultaneously, ambient air, or fluid, is drawn into the cold zone 29 beneath the piston 83 in the cylinder, or vessel, 79.

Simultaneously, the piston 83 expels fluid from its topside through valve 103 to the heat source 115. A check valve 116 can be employed to prevent backflow if the turbine is manifolded to a plurality of the apparatuses, or reactors, such as the one illustrated in FIG. 3.

At the end of the stroke, as illustrated at sub figure 4A, the valves 103 and 105 are switched by the valve operating means 121. The direction of travel of the reciprocally moving pistons is reversed. As the pistons 83 and 85 start their downward movement, the flow directions are as illustrated in sub figure 4B. Specifically, the piston 83 moves the fluid from the cold zone 29 upwardly through the vessel 101 past the hot metal foil 99. As the fluid passes the foil 99, it picks up heat and tends to expand and increase the pressure. As the pressure is increased, however, fluid begins to flow out of the discharge port 114 as indicated by the arrow 127. The fluid flowing out of discharge port 114 is passed to the turbine 25 to power the turbine and effect rotation of the generator 61. Normally, the discharge from the turbine is passed back into the waste heat source area 115 to conserve heat source energy. On the other hand, of course, it can be discharged to the air.

The fluid under the piston 83 also has its temperature raised by adiabatic compression up to the pressure equivalent to the back pressure caused by the turbine 25 and flow losses, thus the cool end of metal foil 99 temperature is elevated above ambient, and as the piston 85 moves downwardly, the air that was formerly brought in through 99 is "exhausted" to the ambient as indicated by the arrows 129 at a similar elevated temperature.

When the pistons reach bottom, as indicated in sub figure 4C, the valves 103 and 105 are again reversed and the direction of the respective pistons changed. Consequently, as the piston structure moves upwardly, the cycle as described hereinbefore with respect to sub figure 4D is repeated. Consequently, the caloric heat storage means in the form of the metallic foil 99 is again heated by stripping heat from the fluid from the waste heat source 115.

It is relatively immaterial where the work producing engine means, such as the turbine 25 be placed. For example, in the embodiment of FIG. 5, the turbine 25 is placed such that on the cooling and intake, the air is sucked inwardly past the turbine 25 to effect rotation of the generator 61. This is similar to that described with respect to passing effluent fluid through the turbine 25 in FIG. 1. In this embodiment, the piston rod 33 is moved reciprocally by the angle arm, or connecting rod, 41, similarly as described with respect to the angle arm 41 of FIG. 1 where the turbine was on the effluent or discharge side.

If desired, of course, turbines 25 may be employed on both the inlet and the outlet sides of the apparatus. As illustrated in FIG. 6, the turbines 25*a* and 25*b* are connected to the exhaust and inlet ports 19, 17. Thus power can be generated on both the inlet and the exhaust portions of the cycle.

As illustrated, the output shafts 59*a* and 59*b* are connected to separate generators 61*a* and 61*b*. If desired, of course, the respective shafts 59*a* and 59*b* can be connected through a ratchet clutch connection to a single generator 61 for effecting operation during the respective power generation portions of the cycle. As illustrated, duplicate work producing means are employed, the turbine 25*a* effecting reciprocal motion of the piston through the piston rod 33, as well as supplying power via conductors such as conductors 63*a*, whereas the turbine 25*b* rotates separate generator 61*b* with separate output 63*b*.

Relatively little input energy is required to circulate the working fluid during the aspiration and power strokes of the engine of this invention.

As described hereinbefore, a plurality of the respective reactor means may be connected into a manifold that is connected with the turbine 25 to have a more nearly constant source of pressurized fluid for rotating the turbine and generator.

The invention has been described at two extremes; one employing internal combustion with exceptionally high temperature being produced locally in the hot zone; and the other employing relatively low temperature waste heat at a predetermined temperature differential above ambient. It should be readily apparent that this invention is primarily a heat engine. Source heat can be derived from any of the conventional exothermic means such as nuclear energy, chemical energy, process heat exchange, electromagnetic radiation and the like. This energy may be supplied directly within the pressure vessel or by transmission through the vessel walls or by direct aspiration of heat source fluids.

From the foregoing it can be seen that this invention provides the objects delineated hereinbefore.

Although the invention has been described with a certain degree of particularity, it is understood that the present disclosure is made only by way of example and that numerous changes in the details of construction and the combination and arragement of parts may be resorted to without departing from the spirit and scope of the invention, reference for the latter purpose being had to the appended claims.

What is claimed is:

1. A method of doing work in a heat engine consisting of a chamber having hot and cold zones at respective ends thereof, a flow path containing a regenerator connecting said hot and cold zones, means movable within said chamber for circulating a working fluid between said hot and cold zones along said flow path, inlet means for the intake of ambient fluid through an inlet work producing means into said cold zone, and outlet means for the discharge from said cold zone to ambient, said method comprising the following steps:

a. circulating said working fluid from said cold zone to said hot zone along said regenerative flow path to heat the working fluid and thereby effect the discharge of a portion of said working fluid from said cold zone through said outlet means to said ambient, thereby generating a potential for power output;

b. adding more heat to said working fluid in said hot zone;

c. moving said working fluid from said hot zone back to said cold zone through said regenerative flow path, thereby cooling said working fluid and effecting the intake of ambient fluid through said inlet means to said cold zone;

d. generating a power output in said inlet work producing means as ambient fluid flows through said inlet work producing means to said cold zone to become said working fluid; and e. repeating steps a through d.

2. The method of claim 1 wherein a discharge work producing means is connected with said outlet means such that a power output is generated in said discharge work producing means when said portion of said working fluid is passed from said cold zone through said outlet means and said discharge work producing means to ambient.

3. The method of claim 1 wherein said heat is added by combusting a fuel with said working fluid.

4. A method of doing work in a heat engine consisting of a chamber having hot and cold zones at respective ends thereof, a flow path containing a regenerator connecting said hot and cold zones, means movable within said chamber for circulating a working fluid between said hot and cold zones along said flow path, inlet means for the intake of ambient fluid into said cold zone, and outlet means for the discharge from said cold zone to ambient through a discharge work producing means, said method comprising the following steps:

a. circulating said working fluid from said cold zone to said hot zone along said regenerative flow path to heat the working fluid thereby effecting discharge of a portion of said working fluid from said cold zone through said outlet means, thereby generating a power output in said discharge work producing means as said working fluid flows from said discharge means through said discharge work producing means to ambient;

b. adding more heat to said working fluid in said hot zone to further effect discharge of a greater portion of said working fluid from said cold zone through said outlet means to said ambient, thereby generating a power output in said discharge work producing means as said working fluid flows from said discharge means through said discharge work producing means to ambient;

c. moving said working fluid from said hot zone back to said cold zone through said regenerative flow path, thereby cooling said working fluid and effecting the intake of ambient fluid through said inlet means to said cold zone, thereby generating a potential for power output; and d. repeating steps a through c.

* * * * *